US007560868B2

(12) United States Patent
Yu et al.

(10) Patent No.: US 7,560,868 B2
(45) Date of Patent: Jul. 14, 2009

(54) BALLAST WITH FILAMENT HEATING AND IGNITION CONTROL

(75) Inventors: Qinghong Yu, Reading, MA (US); Joseph L. Parisella, Beverly, MA (US)

(73) Assignee: Osram Sylvania, Inc., Danvers, MA (US)

( * ) Notice: Subject to any disclaimer, the term of this patent is extended or adjusted under 35 U.S.C. 154(b) by 67 days.

(21) Appl. No.: 11/747,406

(22) Filed: May 11, 2007

(65) Prior Publication Data

US 2008/0278080 A1 Nov. 13, 2008

(51) Int. Cl.
*H05B 39/00* (2006.01)

(52) U.S. Cl. ..... 315/94; 315/106; 315/107; 315/224; 315/308

(58) Field of Classification Search ..... 315/94, 315/106–107, 209 R, 224, 291, 307–309
See application file for complete search history.

(56) References Cited

U.S. PATENT DOCUMENTS

| | | | | |
|---|---|---|---|---|
| 4,207,497 | A * | 6/1980 | Capewell et al. | 315/96 |
| 5,789,866 | A | 8/1998 | Keith et al. | |
| 6,348,769 | B1 * | 2/2002 | Pinchuk et al. | 315/307 |
| 6,501,225 | B1 | 12/2002 | Konopka | |
| 6,531,831 | B2 * | 3/2003 | Chou et al. | 315/225 |
| 6,696,791 | B2 | 2/2004 | Raiser et al. | |
| 2002/0140357 | A1 * | 10/2002 | Randazzo et al. | 315/105 |
| 2003/0122499 | A1 | 7/2003 | Busse et al. | |
| 2006/0138968 | A1 * | 6/2006 | Bakre | 315/209 R |
| 2007/0262734 | A1 * | 11/2007 | Venkat et al. | 315/360 |
| 2008/0042588 | A1 * | 2/2008 | Chan et al. | 315/224 |

FOREIGN PATENT DOCUMENTS

| | | | |
|---|---|---|---|
| DE | 102005022592 | A1 | 11/2006 |
| WO | WO9742795 | A1 | 11/1997 |

OTHER PUBLICATIONS

Related European Patent Application No. 08155630.0; European Search Report dated Sep. 11, 2008, 6 pgs.

* cited by examiner

*Primary Examiner*—David Hung Vu
*Assistant Examiner*—Tung X Le
(74) *Attorney, Agent, or Firm*—Fitch, Even, Tabin & Flannery

(57) ABSTRACT

A ballast (10) for powering at least one gas discharge lamp (70) having heatable filaments (72,74) includes an inverter (200), a resonant output circuit (400) coupled between inverter (200) and lamp (70), and a filament heating and ignition control circuit (600) coupled to inverter (200) and resonant output circuit (400) having a first resonant frequency and a second resonant frequency, wherein the first resonant frequency is substantially greater than the second resonant frequency. Filament heating and ignition control circuit (600) controls inverter (200) and resonant output circuit (400) during a preheat phase and during a normal operating phase. During the preheat phase, resonant output circuit (400) has an effective resonant capacitance corresponding to the first resonant frequency, and provides a first level of heating to the lamp filaments (72,74). During the normal operating phase, resonant output circuit (400) has an effective resonant capacitance corresponding to the second resonant frequency, and provides a second level of heating to the lamp filaments (72,74) that is negligible in comparison with the first level of heating. Control circuit (600) monitors a voltage within resonant output circuit (400) in order to compensate for any variation in the parameters of resonant output circuit (400) and to ensure that an appropriate level of preheating is provided to lamp filaments (72,74).

21 Claims, 3 Drawing Sheets

BALLAST WITH FILAMENT HEATING AND IGNITION CONTROL

FIELD OF THE INVENTION

The present invention relates to the general subject of circuits for powering discharge lamps. More particularly, the present invention relates to a ballast that includes circuitry for controlling the filament heating and ignition voltages that are provided to one or more gas discharge lamps.

BACKGROUND OF THE INVENTION

Electronic ballasts for gas discharge lamps are often classified into two groups—preheat type and instant start type—according to how the lamps are ignited. In preheat type ballasts, the lamp filaments are initially preheated at a relatively high level (e.g., 7 volts peak) for a limited period of time (e.g., one second or less) before a moderately high voltage (e.g., 500 volts peak) is applied across the lamps in order to ignite the lamps. In instant start ballasts, the lamp filaments are not preheated, so a significantly higher starting voltage (e.g., 1000 volts peak) is required in order to ignite the lamps. It is generally acknowledged that instant start type operation offers certain advantages, such as the ability to ignite the lamps at a lower ambient temperature and greater energy efficiency (i.e., greater light output per watt) due to no expenditure of power on filament heating during normal operation of the lamps. On the other hand, preheat type operation usually results in considerably greater lamp life than instant start type operation.

For many existing preheat type ballasts, a substantial amount of power is unnecessarily expended on heating the lamp filaments during normal operation of the lamps (i.e., after the lamps have ignited). It is thus desirable to have preheat type ballasts in which filament power is substantially reduced or eliminated once the lamps are ignited. Currently, there are at least three known approaches that are directed toward that goal.

In a first approach, which may be termed a "passive" method and which has been commonly employed in so-called "rapid start" ballasts, the filaments are heated via windings on an output transformer that also provides the high voltage for igniting the lamps. A known drawback of this approach is that it is inherently limited as to the degree to which filament heating power may be reduced once the lamps ignite and begin to operate. A detailed discussion of the difficulties inherent in this approach is provided in the "Background of the Invention" section of U.S. Pat. No. 5,998,930, the relevant portions of which are incorporated herein by reference.

A second approach employs a separate filament heating transformer, in combination with one or more electronic switches (e.g., power transistors, such as field-effect transistors), in order to provide preheating of the lamp filaments prior to ignition of the lamps. Once the lamps are ignited, the electronic switches are deactivated, thereby preventing any further heating of the lamp filaments. This approach has been used quite successfully, and has the advantage of completely eliminating any heating of the lamp filaments after lamp ignition. However, this approach has the considerable disadvantage of requiring a considerable amount of additional circuitry (e.g., a filament heating transformer, one or more power transistors, etc.). That fact makes this approach quite costly to implement, especially in the case of ballasts for powering two or more lamps, in which case multiple electronic switches, along with associated circuitry, are typically required.

In a third approach, which is common in so-called "program start" ballasts, an inverter is operated at one frequency (i.e., the preheat frequency) in order to preheat the lamp filaments, then "swept" to another frequency (i.e., the normal operating frequency) in order to ignite and operate the lamps. A common circuit topology for such ballasts includes a voltage-fed inverter (e.g., half-bridge type) and a series resonant output circuit; the series resonant output circuit includes a resonant inductor that commonly includes secondary windings for providing heating of the lamp filaments. This topology has been widely and successfully employed in program start ballasts for powering many common types of lamps. Because this approach is difficult and/or costly to implement in ballasts having self-oscillating type inverters, it is typically employed in ballasts having driven type inverters. More importantly, however, this approach has the significant limitation of not being capable of providing anything that is even close to a complete elimination of filament heating after lamp ignition. This limitation follows from the fact that, for the types of circuitry commonly employed to realize this approach, the ratio of the preheat frequency to the operating frequency is typically limited to be no more than 1.6 or 1.7; consequently, a significant amount of power is still unnecessarily expended upon heating the lamp filaments during normal operation.

What is needed, therefore, is a preheat type ballast in which: (i) the filaments are properly preheated prior to lamp ignition; (ii) little or no power is expended on filament heating during normal operation of the lamps; and (iii) the required circuitry may be realized in a convenient and cost-effective manner. Such a ballast would represent a significant advance over the prior art.

A further problem with existing preheat type ballasts that utilize one or more resonant output circuit(s) is that the effective resonant frequency/frequencies of the resonant output circuit(s) are subject to variation due to a number of factors. This variation may substantially interfere with, among other things, the requirement of generating suitable voltages for properly preheating the filaments of the lamp(s).

As is known to those skilled in the art, the effective resonant frequency of a resonant circuit is dependent upon certain parameters, including the inductance of the resonant inductor and the capacitance of the resonant capacitor. In practice, those parameters are subject to component tolerances, and may vary by a considerable amount. Additionally, the effective resonant frequency of a resonant circuit is also influenced by the lead lengths and/or the nature of the electrical wiring that connects the ballast to the lamp(s); the electrical wiring introduces parasitic capacitances (also referred to as "stray capacitances") which effectively alter the effective resonant frequency of the resonant circuit(s), and which therefore affect the magnitude of the preheating voltage(s) provided by the ballast to the filaments of the lamp(s). Such parameter variation makes it difficult and/or impractical to pre-specify (i.e., on a priori basis) an operating frequency of the inverter so as to ensure that suitable preheating voltages are provided to the filaments of the lamp(s).

The aforementioned difficulties arising from parameter variation are even more problematic when the ballast includes multiple resonant circuits and/or when the wiring between the ballast output connections and the lamps has a considerable length; in the latter case, the resulting parasitic capacitance becomes a very significant factor. Accordingly, for a given predefined inverter operating frequency, the magnitudes of the filament preheating voltages that are provided by a resonant output circuit may vary considerably, and may, in some instances, prove to be either insufficient or at least considerably less than ideal, for preheating the lamp filaments in a desired manner.

Thus, a further need exists for a ballast that is capable of compensating for parameter variations that affect a resonant output circuit, so as to ensure that the ballast provides an appropriate level of preheating for the lamp filaments. A ballast with such a capability would further represent a considerable advance over the prior art.

DETAILED DESCRIPTION OF THE PREFERRED EMBODIMENTS

Figure 1:
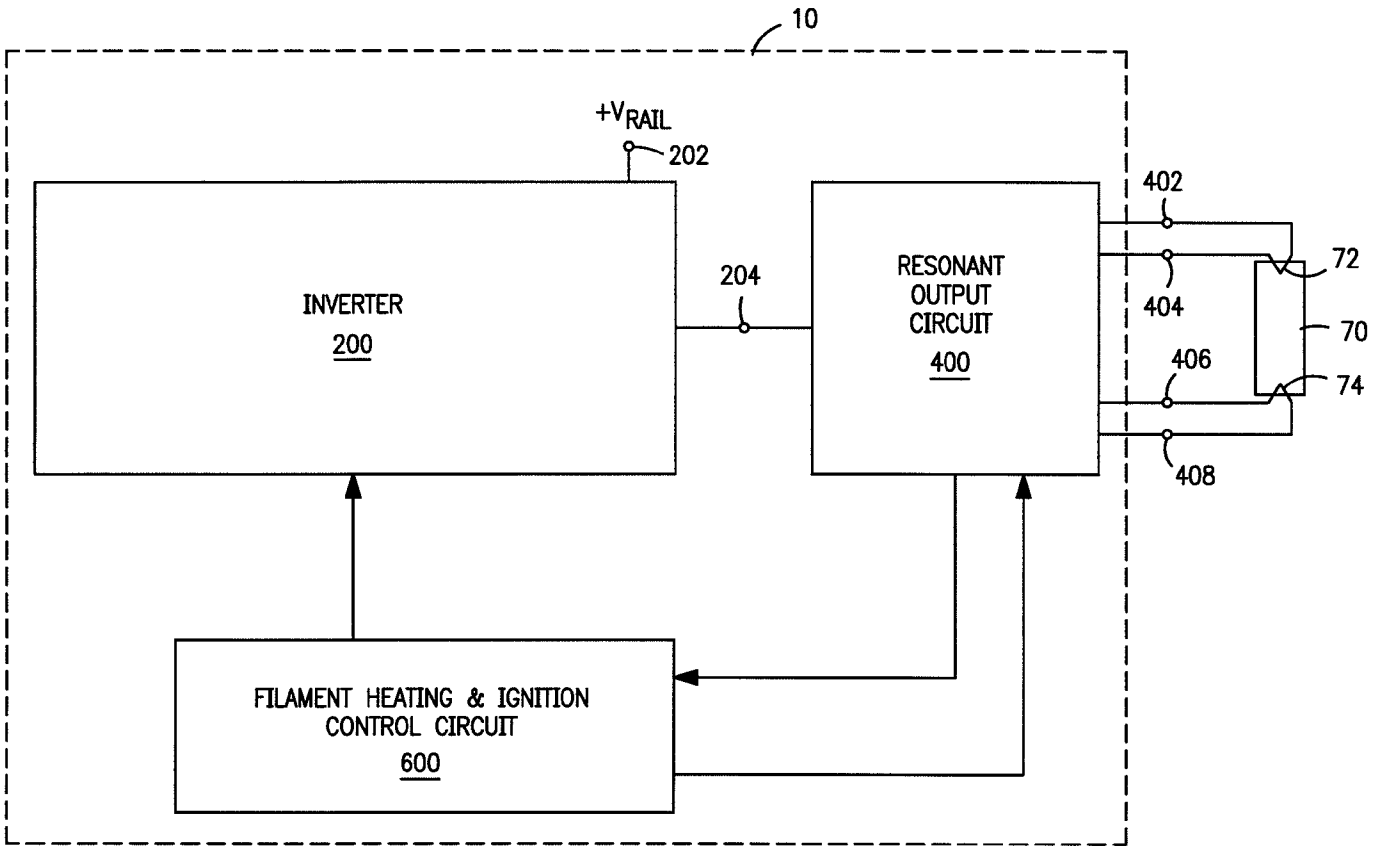
FIG. 1 is a block electrical diagram of a ballast for powering a gas discharge lamp, in accordance with the preferred embodiments of the present invention.

FIG. 1 describes a ballast 10 for powering a gas discharge lamp 70 having a pair of filaments 72,74. Ballast 10 comprises an inverter 200, a resonant output circuit 400, and a filament heating and ignition control circuit 600.

During operation of ballast 10, inverter 200 provides an inverter output voltage having an operating frequency. Resonant output circuit 400 is coupled between inverter 200 and lamp 70, and has a first resonant frequency and a second resonant frequency; the first resonant frequency is selected to be substantially greater than the second resonant frequency. Filament heating and ignition control circuit 600 (hereinafter referred to simply as "control circuit 600") is coupled to inverter 200 and resonant output circuit 400. During operation, control circuit 600 controls inverter 200 and resonant output circuit 400 in the following manner.

In a preheat phase, during which time lamp filaments 72,74 are preheated, resonant output circuit 400: (i) has an effective resonant capacitance corresponding to the first resonant frequency; and (ii) provides a first level of heating to lamp filaments 72,74.

In a normal operating phase (which follows the preheat phase), during which time lamp 70 is ignited and then operates in a normal manner, resonant output circuit 400: (i) has an effective resonant capacitance corresponding to the second resonant frequency; and (ii) provides a second level of heating to lamp filaments 72,74. The second level of heating is negligible in comparison to (e.g., having a power level that is on the order of only about 10% or so of) the first level of heating.

Preferably, and as described in further detail herein, the first resonant frequency is selected to be on the order of at least about 2.5 times greater than the second resonant frequency. A relatively wide separation between the first frequency (i.e., the preheat frequency) and the second frequency (i.e., the normal operating frequency) is desirable in order to minimize the amount of electrical power that is expended upon heating lamp filaments 72,74 during the normal operating phase, while at the same time ensuring that a sufficient amount of electrical power is provided for properly preheating lamp filament 72,74 during the preheat phase. By way of example, in a preferred implementation of ballast 10, the first frequency is selected to be on the order of about 105 kilohertz, while the second frequency is selected to be on the order of about 42 kilohertz.

In order to provide the aforementioned functionality, control circuit 600 is configured to monitor a voltage within resonant output circuit 400. In response to the monitored voltage reaching a specified level (i.e., a level which corresponds to output circuit 400 providing an appropriate level of preheating to filaments 72,74), control circuit 600 acts to provide the preheat phase, during which time the operating frequency of inverter 200 is maintained at a first present value (e.g., 105 kilohertz or so) for a predetermined preheating period (e.g., 500 millseconds or so). Upon completion of the preheat phase, control circuit 600 acts to provide the operating phase. During the operating phase, the operating frequency of inverter 200 is allowed to decrease from the first present value to a lower value (e.g., 42 kilohertz or so) in order to ignite and operate lamp 70.

As described in FIG. 1, inverter 200 includes an input 202 and an inverter output terminal 204. During operation, inverter 200 receives, via input 202, a substantially direct current (DC) voltage, $V_{RAIL}$. $V_{RAIL}$ is typically provided by suitable rectification circuitry (e.g., a combination of a full-wave bridge rectifier and a power factor correcting DC-to-DC converter, such as a boost converter) which receives power from conventional alternating current (AC) voltage source (e.g., 120 volts rms or 277 volts rms, at 60 hertz). By way of example, $V_{RAIL}$ may be selected to have a magnitude that is on the order of about 460 volts. During operation, inverter 200 provides, at inverter output terminal 204 (and taken with respect to a circuit ground), an inverter output voltage having an operating frequency that is typically selected to be greater than about 20,000 hertz.

Resonant output circuit 400 is coupled between inverter output terminal 204 and lamp 70. Resonant output circuit 400 includes at least four output connections 402,404,406,408 adapted for coupling to filaments 72,74 of lamp 70. More particularly, first and second output connections 402,404 are adapted for coupling to a first filament 72 of lamp 70, while third and fourth output connections 406,408 are adapted for coupling to a second filament 74 of lamp 70. Preferably, and as described in the preferred embodiments herein, resonant output circuit 400 is realized as series resonant type output circuit.

During operation, resonant output circuit 400 receives the inverter output voltage (via inverter output terminal 204) provides (via output connections 402,404,406,408): (1) heating voltages for preheating filaments 72,74; (2) an ignition voltage for igniting lamp 70; and (3) a magnitude-limited current for operating lamp 70. For instance, if lamp 72 is realized as a F32T8 type lamp, the voltages for preheating filaments 72,74 are typically selected to be on the order of 3.5 volts rms, the ignition voltage for igniting lamp 72 is typically selected to be on the order of about 350 volts rms, and the magnitude-limited operating current is typically selected to be on the order of about 180 milliamperes.

Filament heating and ignition control circuit 600 (hereinafter referred to simply as "control circuit 600") is coupled to inverter 200 and to resonant output circuit 400. During operation, control circuit 600 monitors a voltage within resonant output circuit 400. In response to the monitored voltage reaching a specified level, indicating that the filament preheating voltages (e.g., the voltages between output connections 402,404 and output connections 406,408 prior to lamp ignition) have attained a magnitude that is sufficient for properly preheating filaments 72,74, control circuit 600 acts to provide the preheat phase. After completion of the preheat phase, control circuit 600 acts to provide an operating phase for igniting and operating lamp 70.

Figure 2:
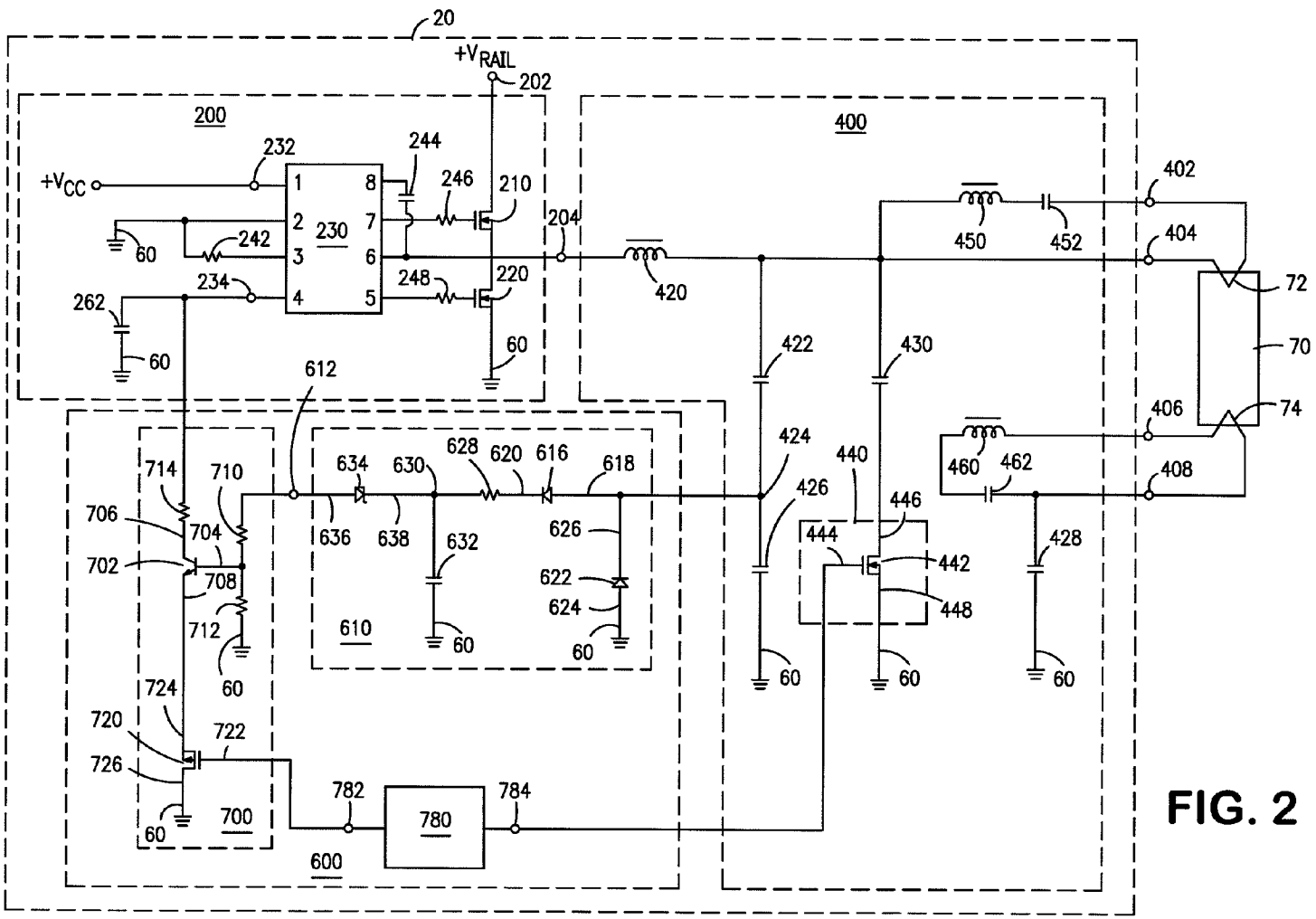
FIG. 2 is an electrical diagram of a ballast for powering a gas discharge lamp, in accordance with a first preferred embodiment of the present invention.
Figure 3:
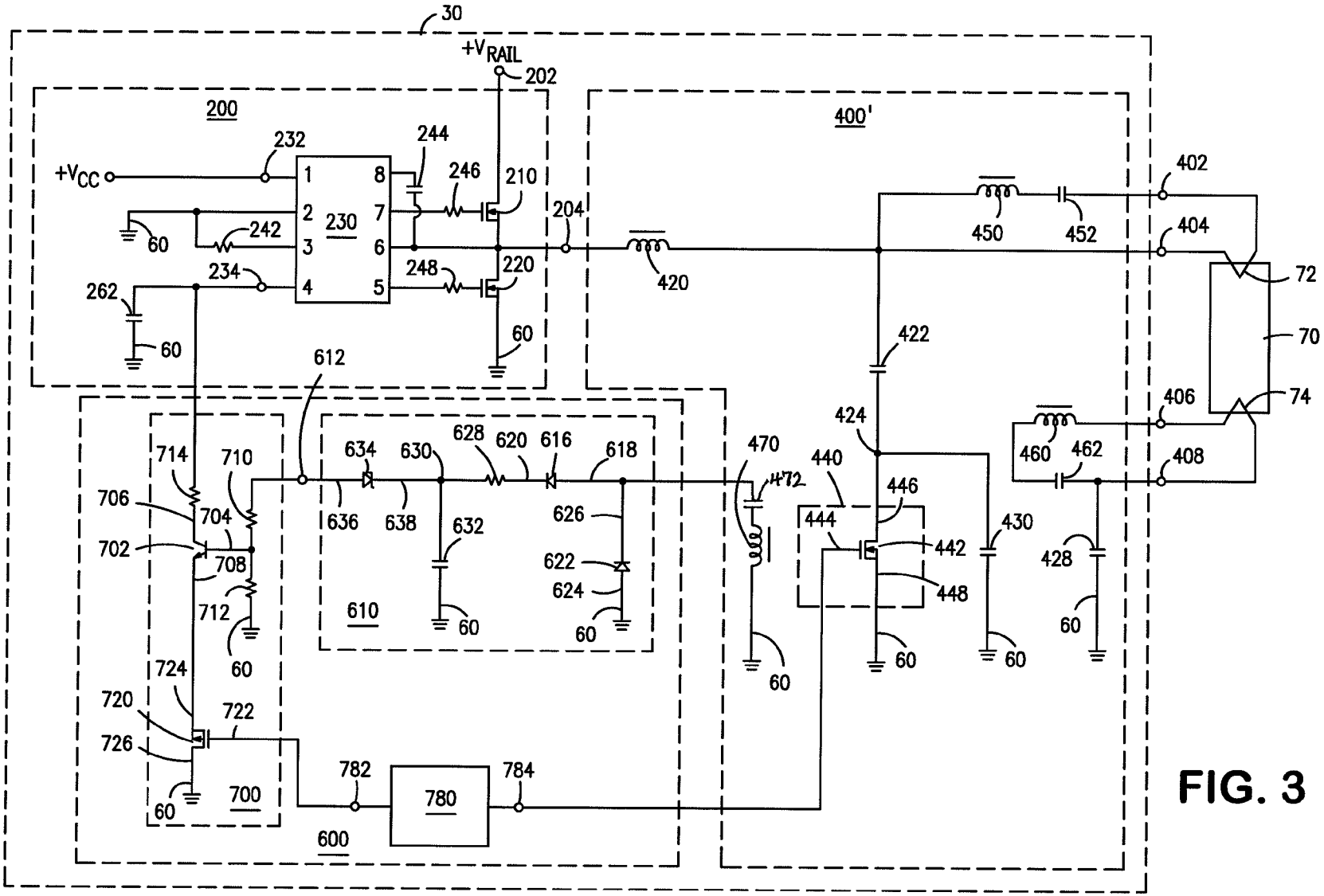
FIG. 3 is an electrical diagram of a ballast for powering a gas discharge lamp, in accordance with a second preferred embodiment of the present invention.

Turning momentarily to the preferred embodiments depicted in FIGS. 2 and 3, resonant output circuits 400,400' each include a first resonant capacitor 422, an auxiliary resonant capacitor 430, and an electronic switch 440. Auxiliary resonant capacitor 430 is coupled to first resonant capacitor 422. Electronic switch 440 is coupled to auxiliary resonant capacitor 430.

As will be described in further detail herein, electronic switch 440 is controlled (i.e., initially turned off, and then turned on) by filament heating and ignition control circuit 600 in order to alter the effective resonant capacitances, and hence the effective resonant frequencies, of output circuits 400,400' so as to provide the preheat and operating phases in a manner that is favorable to the intended operation and useful life of lamp 70 and to the energy efficiency of ballasts 20,30.

During the preheat phase, control circuit 600 provides two primary control functions. First, control circuit 600 acts such that electronic switch 440 (within resonant output circuit 400) is turned off. Second, control circuit 600 acts such that the operating frequency of inverter 200 is maintained as a first present value for a predetermined preheating period (e.g., 500 milliseconds or so). By maintaining the operating frequency at the first present value during the preheat phase, control circuit 600 allows resonant output circuit 400 to provide appropriate voltage/current/power for preheating filaments 72,74 at a suitable level.

During the operating phase (which follows the preheat phase), control circuit 600 also provides two primary control functions. First, control circuit 600 acts such that electronic switch 440 (within resonant output circuit 400) is turned on. Second, control circuit 600 acts such that the operating frequency of inverter 200 is allowed to decrease from the first present value. The operating frequency is allowed to decrease from the first present value for purposes of generating a suitably high voltage for igniting, and a magnitude-limited current for operating, lamp 70.

It can thus be appreciated that electronic switch 440 is utilized, during the preheat and operating phases, to control the effective resonant capacitance, and hence the effective resonant frequency, of resonant output circuit 400. Further details regarding the operation of electronic switch 440 are discussed below with reference to the preferred embodiments as depicted in FIGS. 2 and 3.

FIG. 2 describes a first preferred embodiment of ballast 10 (which is designated, and hereinafter referred to, as ballast 20).

As depicted in FIG. 2, resonant output circuit 400 comprises first, second, third, and fourth output connections 402, 404,406,408, a resonant inductor (comprising a primary winding 420, a first secondary winding 450, and a second secondary winding 460, wherein secondary windings 450, 460 are understood to be magnetically coupled to primary winding 420), first resonant capacitor 422, auxiliary resonant capacitor 430, electronic switch 440, first and second filament capacitors 452,462, a direct current (DC) blocking capacitor 428, and a voltage-divider capacitor 426. First and second output connections 402,404 are adapted for coupling to first filament 72 of lamp 70, while third and fourth output connections 406,408 are adapted for coupling to second filament 74 of lamp 70. Primary winding 420 (of the resonant inductor) is coupled to inverter output terminal 204. First filament capacitor 452 is coupled in series with first secondary winding 450, and the series combination of first filament capacitor 452 and first secondary winding 450 is coupled between first and second output connections 402,404. Second filament capacitor 462 is coupled in series with second secondary winding 460, and the series combination of second filament capacitor 462 and second secondary winding 460 is coupled between third and fourth output connections 406,408. First resonant capacitor 422 is coupled between second output connection 404 and a first node 424. Voltage-divider capacitor 426 is coupled between first node 424 and circuit ground 60. DC blocking capacitor 428 is coupled between fourth output connection 408 and circuit ground 60. Auxiliary resonant capacitor 430 and electronic switch 440 are arranged as a series circuit that is coupled between second output connection 404 and circuit ground 60.

As depicted in FIG. 2, electronic switch 440 may be realized by a N-channel field effect transistor (FET) having a gate 444, a drain 446, and a source 448, wherein gate 444 is coupled to control circuit 600, drain 446 is coupled to auxiliary resonant capacitor 430, and source 448 is coupled to circuit ground 60. Alternatively, electronic switch 440 may be realized by any of a number of suitable power switching devices, such as a triac.

During operation of ballast 20, electronic switch 440 is turned off during the preheat phase. With electronic switch 440 turned off, auxiliary resonant capacitor 430 is effectively removed from (i.e., it exerts no influence upon the operation of) output circuit 400; that is, during the preheat phase, the effective resonant capacitance of output circuit 400 is merely equal to the capacitance of capacitor 422 (in addition to any parasitic capacitances that may be present due to output wiring).

Conversely, electronic switch 440 is turned on during the operating phase. With electronic switch 440 turned on, auxiliary resonant capacitor 430 is effectively placed in parallel with first resonant capacitor 422; that is, during the operating phase, the effective resonant capacitance of output circuit 400 is equal to the sum of the capacitances of capacitors 422,430 (in addition to any parasitic capacitances that may be present due to output wiring, etc.), which is greater than the effective resonant capacitance during the preheat phase. Consequently, the effective resonant frequency of output circuit 400 is less during the operating phase than during the preheat phase.

With the effective resonant frequency of output circuit 400 being decreased during the operating phase, and with the operating frequency of inverter 200 being decreased in order to ignite and operate lamp 70, the amount of power that is expended upon heating filaments 72,74 during the operating phase is decreased in a considerable manner. As will be appreciated by those skilled in the art, a marked decrease (e.g., 2.5 times or more) in the inverter operating frequency between the preheat phase and the operating phase results in a marked increase (e.g., 2.5 times or more) in the impedances of capacitors 452,462 and, correspondingly, results in a dramatic decrease in the amount of power that is delivered to filaments 72,74 during the operating phase.

In this way, electronic switch 440 is utilized, in conjunction with auxiliary resonant capacitor 430, to alter the effective resonant capacitance and the effective resonant frequency of output circuit 400 so as to provide an appropriate level of filament preheating during the preheat phase, while at the same time dramatically reducing the amount of power that is expended upon heating the lamp filaments during the operating phase.

As illustrated in FIG. 2, inverter 200 is preferably realized as a driven half-bridge type inverter that includes input 202, inverter output terminal 204, first and second inverter switches 210,220, and an inverter driver circuit 230. As previously recited, input 202 is adapted for receiving a source of substantially DC voltage, $V_{RAIL}$. First and second inverter switches 210,220 are preferably realized by N-channel field-effect transistors (FETs). Inverter driver circuit 230 is coupled to inverter FETs 210,220, and may be realized by any of a number of available devices; preferably, inverter driver circuit 230 is realized by a suitable integrated circuit (IC) device, such as the IR2520 high-side driver IC manufactured by International Rectifier, Inc.

During operation of ballast 20, inverter driver circuit 230 commutates inverter FETs 210,220 in a substantially complementary manner (i.e., such that when FET 210 is on, FET 220 is off, and vice-versa) to provide a substantially squarewave voltage between inverter output terminal 204 and circuit ground 60. Inverter driver circuit 230 includes a DC supply input 232 (pin 1 of 230) and a voltage controlled oscillator (VCO) input 234 (pin 4 of 230). DC supply input 232 receives operating current (i.e., for powering inverter driver circuit 230) from a DC voltage supply, $+V_{CC}$, that is typically selected to provided a voltage that is on the order of about +15 volts or so. The operating frequency of inverter 200 is set in dependence upon a voltage provided to VCO input 234. More specifically, the instantaneous voltage that is present at VCO input 234 determines the instantaneous frequency at which inverter driver circuit 230 commutates inverter transistors 210,220; in particular, the frequency decreases as the voltage at VCO input 234 increases. It will be understood by those skilled in the art that the instantaneous frequency at which inverter driver circuit 230 commutates inverter transistors 210,220 is the same as the fundamental frequency (referred to herein as the "operating frequency") of the inverter output voltage provided between inverter output terminal 204 and circuit ground 60. Other components associated with inverter driver circuit 230 include capacitors 244,262 and resistors 242,246,248, the functions of which are known to those skilled in the art.

Advantageously, ballast 20 resolves the aforementioned difficulties (as discussed in the "Background of the Invention" section of the present application) by actively monitoring the voltage at first node 424, selecting an operating frequency for inverter 200 that ensures that sufficient voltage is provided (between output connections 402,404 and between output connections 406,408) for properly preheating filaments 72,74 of lamp 70, and then, after ignition of lamp 70, altering the effective resonant frequency of output circuit 400 and the operating frequency of inverter 200, so as to dramatically limit the amount of power that is expended upon heating lamp filaments 72,74 during normal operation of lamp 70.

The voltage at first node 424 is representative of the voltages that exist across secondary windings 450,460 (which are themselves proportional to the voltage across primary winding 420), and is thus indicative of whether or not appropriate voltages are being provided for properly preheating filaments 72,74 of lamp 70. Following application of power to ballast 20, control circuit 600 allows the inverter operating frequency to decrease until at least such time as the monitored voltage (at first node 424) reaches a specified level. Once that occurs, control circuit 600 maintains the operating frequency at its present level (thereby maintaining the filament preheating voltages at a desired level) for a predetermined period of time, so as to give the filaments a chance to be sufficiently heated prior to attempting to ignite lamp 70. In this way, ballast 20 automatically compensates for parameter variations within output circuit 400 (due to variations in the values of the resonant circuit components or due to parasitic capacitances attributable to the wiring between the ballast output connections 402,404 and lamp 70), and thus ensures that suitable filament preheating voltages are provided to lamp 70. Upon completion of the preheat phase, ballast 20 functions to reduce the operating frequency of inverter 200, as well as to reduce the effective resonant frequency of output circuit 400, so as to ignite and operate lamp 70 while at the same time reducing the amount of power provided to filaments 72,74 to a level that is negligible in comparison with the amount of power that is provided to filaments 72,74 during the preheat phase.

Preferred circuitry for implementing control circuit 600 is now described with reference to FIG. 2 as follows.

As depicted in FIG. 2, control circuit 600 preferably includes a voltage detection circuit 610, a frequency-hold circuit 700, and a timing control circuit 780. Preferred structures for realizing voltage detection circuit 610, frequency-hold circuit 700, and timing control circuit 780, as well as pertinent operational details of those circuits, are described as follows.

Voltage detection circuit 610 is coupled to resonant output circuit 400, and includes a detection output 612. During operation, voltage detection circuit 610 serves to provide a detection signal at detection output 612 in response to the monitored voltage (i.e., the voltage across voltage-divider capacitor 426) reaching the aforementioned specified level. As previously explained, the monitored voltage is representative of the filament heating voltages provided to filaments 72,74 via output connections 402,404 and 406,408. Thus, the monitored voltage being at the specified level corresponds to the filament heating voltage being at a desired level (e.g., 3.5 volts rms).

As described in FIG. 2, voltage detection circuit 610 preferably comprises a first diode 616, a second diode 622, a low-pass filter comprising a series combination of a filter resistor 628 and a filter capacitor 632, and a zener diode 634. First diode 616 has an anode 618 and a cathode 620. Second diode 622 has an anode 624 and a cathode 626. Anode 618 of first diode 616 is coupled to cathode 626 of second diode 622, as well as to first resonant output circuit 400 (i.e., to first node 424). Anode 624 of second diode 622 is coupled to circuit ground 60. Filter resistor 628 is coupled between cathode 620 of first diode 616 and a node 630 that is situated at a junction between filter resistor 628 and filter capacitor 632. Filter capacitor 632 is coupled between node 630 and circuit ground 60. Cathode 638 of zener diode 634 is coupled to node 630. Anode 636 of zener diode 634 is coupled to detection output 612.

During operation of voltage detection circuit 610, the voltage that develops across filter capacitor 632 is a filtered version of the positive half-cycles of the monitored voltage at node 424. Filter resistor 628 and filter capacitor 632 serve to suppress any high frequency components present in the monitored voltage. When the voltage at node 630 reaches the zener breakdown voltage of zener diode 634, zener diode 634 becomes conductive and provides, at detection output 612, a voltage signal which indicates that the voltage at first node 424 (i.e., the voltage across voltage-divider capacitor 426) has reached the specified level.

Timing control circuit 780 is coupled to electronic switch 440 (in resonant output circuit 400) and to frequency-hold circuit 700. More specifically, timing control circuit 780 includes a first output 784 and a second output 782. First output 784 is coupled to electronic switch 440, while second output 782 is coupled to frequency-hold circuit 700. Timing control circuit 780 is preferably realized by a suitable programmable microcontroller integrated circuit, such as Part No. PIC10F510 (manufactured by Microchip, Inc.), which has the advantages of relatively low material cost and low operating power requirements During operation, microcontroller 780 serves to control, according to internal timing functions (which are programmed into microcontroller 780), the timing and activation of electronic switch 440 (within output circuit 400), as well as a portion of the functionality associated with frequency-hold circuit 700. More particularly, during the preheat phase, microcontroller 780 provides: (i) a preheat control signal at first output 784 for deactivating electronic switch 440; and (ii) an enable signal at second output 782 for enabling frequency-hold circuit 700. With regard to the first function, the preheat control signal at first output 784 is provided for the duration of the preheat phase (i.e., for the predetermined period of time); upon completion of the preheat phase, the signal at first output 784 reverts to a level (e.g., 15 volts or so) that activates (i.e., turns on) electronic switch 440. Further details regarding the second function (i.e., the enable signal) are explained with reference to a preferred structure and operation of frequency-hold circuit 700, as detailed below.

Frequency-hold circuit 700 is coupled to detection output 612 of voltage detection circuit 610, VCO input 234 of inverter driver circuit 230, and second output of timing control circuit 780. During operation, and in response to the detection signal being present at detection output 612 (thereby indicating that the filament preheating voltage has attained a sufficiently high level) and the enable signal being present at second output 782 of microcontroller 780, frequency-hold circuit 700 substantially maintains the voltage provided to VCO input 234 at a present level for the predetermined period of time (i.e., for the duration of the preheat phase). By maintaining the voltage at VCO input 234 at its present level, the operating frequency of inverter 200 is correspondingly maintained, thereby maintaining suitable voltages (across secondary windings 450,460) for properly preheating filaments 72,74 of lamp 70.

As described in FIG. 2, frequency-hold circuit 700 preferably comprises a first electronic switch 702, a second electronic switch 720, a first biasing resistor 710, a second biasing resistor 712, and a pull-down resistor 714. First electronic switch 702 is preferably realized by a NPN type bipolar junction transistor (BJT) having a base 704, an emitter 708, and a collector 706. Second electronic switch 720 is preferably realized by a logic level P-channel field-effect transistor (FET) having a gate 722, a drain 724, and a source 726. Gate 722 of FET 720 is coupled to second output 782 of microcontroller 780. Source 726 of FET 720 is coupled to circuit ground 60. Drain 724 of FET 720 is coupled to emitter 708 of BJT 702. First biasing resistor 710 is coupled between detection output 612 and base 704 of BJT 702. Second biasing resistor 712 is coupled between base 704 of BJT 702 and circuit ground 60. Pull-down resistor 714 is coupled between VCO input 234 of inverter driver circuit 230 and collector 706 of BJT 702.

During operation of ballast 20, frequency-hold circuit 700 is activated (i.e., BJT 702 and FET 720 are both turned on) when the voltage signal at detection output 612 indicates that the monitored voltage has reached the specified level, and when the enable signal at second output 782 of microcontroller 780 is at a suitable level (e.g., zero volts or so). As previously recited, microcontroller 780 ensures that FET 720 is turned on during the preheat phase. Thus, during the preheat phase, with transistors 702,720 both turned on, VCO input 234 of inverter driver circuit 230 is essentially coupled to circuit ground 60 via pull-down resistor 706 so as to prevent any further increase in the voltage at VCO input 234. Consequently, the voltage at VCO input 234 is essentially maintained at its present value, thereby causing the inverter operating frequency to be essentially maintained at its present value for as long as transistors 702,720 remain turned on. In this way, frequency-hold circuit 700 operates to maintain the inverter operating frequency at a level that is appropriate for allowing output circuit 400 to provide the desired preheating of lamp filaments 72,74.

It will thus be appreciated by those skilled in the art that ballast 20 functions to effectively "seek out" a suitable operating frequency at which proper preheating of lamp filaments 72,74 can be provided.

Upon completion of the preheat phase, microcontroller 780 (via second output 782) deactivates FET 720. With FET 720 turned off, frequency-hold circuit 700 is effectively disabled, thereby allowing the voltage at VCO input 234 to increase, and thus allowing the operating frequency of inverter 200 to decrease from its relatively high level during the preheat phase.

At about the same time as FET 720 is turned off, electronic switch 440 is turned on by means of a suitable voltage (e.g., +15 volts or so) being provided at first output 784 of microcontroller 780. With electronic switch 440 turned on, auxiliary resonant capacitor 430 is effectively coupled in parallel with first resonant capacitor 422, thereby decreasing the effective resonant frequency of output circuit 400. As the operating frequency of inverter 200 decreases, it eventually falls to a level (i.e., in the vicinity of the effective resonant frequency of output circuit 400 which corresponds to the aforementioned "second resonant frequency") for which sufficient voltage is provided (between each of the pairs of output connections 402,404 and 406,408) for igniting lamp 70. With the operating frequency being dramatically reduced from its previously high level during the preheat phase, the impedances of capacitors 452,462 are correspondingly dramatically increased, thereby greatly limiting the amount of voltage/current/power that is provided to filaments 72,74 during the operating phase. In this way, ballast 20 provides an operating phase in which very little power is expended upon heating lamp filaments 72,74.

Ballast 20 thus provides an economical and reliable solution to the problem of providing filament preheating to a lamp, while at the same time greatly limiting any wasteful heating of the filaments during normal operation of the lamp. Additionally, ballast 20 automatically compensates for parameter variations in resonant output circuit 400 (due to component tolerances and/or attributable to parasitic capacitances due to output wiring, the latter of which have the effect of reducing the equivalent resonant capacitance), thereby providing appropriate voltages for properly preheating filaments 72,74 of lamp 70 in a manner that it reliable and that preserves the useful operating life of lamp 70. Ballast 20 utilizes a controlled electronic switch 440 within output circuit 400 in order to effectively modify the resonant characteristics of output circuit 400 in a manner that minimizes filament heating during normal operation of lamp 70 and that thereby significantly enhances the operating energy efficiency of ballast 20 and lamp 70.

FIG. 3 describes a second preferred embodiment of ballast 10 (which is designated, and hereinafter referred to, as ballast 30).

Much of the preferred structure for ballast 30 is the same as that for ballast 20 (as previously described with reference with FIG. 2). More specifically, the preferred structures and operational details of inverter 200 and control circuit 600 are essentially identical to that which was previously described with regard to ballast 20. However, there are some notable differences with regard to the preferred structure and operation of output circuit 400'.

As depicted in FIG. 3, resonant output circuit 400' comprises first, second, third, and fourth output connections 402, 404,406,408, a resonant inductor (comprising a primary winding 420, a first secondary winding 450, a second secondary winding 460, and an auxiliary secondary winding 470; it is understood that secondary windings 450,460,470 are each magnetically coupled to primary winding 420), first resonant capacitor 422, auxiliary resonant capacitor 430, electronic switch 440, first and second filament capacitors 452,462, a direct current (DC) blocking capacitor 428, and a coupling capacitor 472. First and second output connections 402,404 are adapted for coupling to first filament 72 of lamp 70, while third and fourth output connections 406,408 are adapted for coupling to second filament 74 of lamp 70. Primary winding 420 (of the resonant inductor) is coupled to inverter output terminal 204. First filament capacitor 452 is coupled in series with first secondary winding 450, and the series combination of first filament capacitor 452 and first secondary winding 450 is coupled between first and second output connections 402,404. Second filament capacitor 462 is coupled in series with second secondary winding 460, and the series combination of second filament capacitor 462 and second secondary winding 460 is coupled between third and fourth output connections 406,408. First resonant capacitor 422 is coupled between second output connection 404 and a first node 424. DC blocking capacitor 428 is coupled between fourth output connection 408 and circuit ground 60. Auxiliary resonant capacitor 430 and electronic switch 440 are arranged as a parallel circuit that is coupled between first node 424 and circuit ground 60. A series combination of coupling capacitor 472 and auxiliary secondary winding 470 is coupled to control circuit 600.

A relevant structural difference between output circuit 400 (as described in FIG. 2) and output circuit 400' (as described in FIG. 3) is that the former utilizes a voltage-divider capacitor 426, while the latter utilizes an auxiliary secondary winding 470 (which is magnetically coupled to primary winding 420 of the resonant inductor), for allowing control circuit 600 to monitor a voltage within output circuit 400'.

As depicted in FIG. 3, electronic switch 440 may be realized by a N-channel field effect transistor (FET) having a gate 444, a drain 446, and a source 448, wherein gate 444 is coupled to control circuit 600, drain 446 is coupled to auxiliary resonant capacitor 430, and source 448 is coupled to circuit ground 60. Alternatively, electronic switch 440 may be realized by any of a number of suitable power switching devices, such as a triac.

During operation of ballast 30, electronic switch 440 is turned off during the preheat phase. With electronic switch 440 turned off, auxiliary resonant capacitor 430 is effectively coupled in series with first resonant capacitor 422. That is, during the preheat phase, the effective resonant capacitance of output circuit 400' is equal to the equivalent series capacitance of capacitors 422,430 (in addition to any parasitic capacitances that may be present due to output wiring). Consequently, during the preheat phase, the effective resonant frequency of output circuit 400' is at a relatively high level.

Conversely, during the operating phase, electronic switch 440 is turned on. With electronic switch 440 turned on, auxiliary resonant capacitor 430 is effectively shorted by electronic switch 440, and thus exerts no influence upon the operation of output circuit 400'. In other words, during the operating phase, the effective resonant capacitance of output circuit 400' is merely equal to the capacitance of first resonant capacitor 422 (in addition to any parasitic capacitances that may be present due to output wiring, etc.), which is greater than the effective resonant capacitance during the preheat phase. Consequently, during the operating phase, the effective resonant frequency of output circuit 400' is at relatively low level.

With the effective resonant frequency of output circuit 400' being decreased during the operating phase, and with the operating frequency of inverter 200 being decreased in order to ignite and operate lamp 70, the amount of power that is expended upon heating filaments 72,74 is likewise decreased in a considerable manner. As will be appreciated by those skilled in the art, a dramatic decrease (e.g., 2.5 times or more) in the inverter operating frequency between the preheat phase and the operating phase results in a dramatic increase (e.g., 2.5 times or more) in the impedances of capacitors 452,462 and, correspondingly, results in a dramatic decrease in the amount of power that is delivered to filaments 72,74 during the operating phase.

In this way, electronic switch 440 is utilized, in conjunction with auxiliary resonant capacitor 430, to alter the effective resonant frequency of output circuit 400' so as to provide an appropriate level of filament preheating, while at the same time greatly reducing the amount of power that is expended upon heating the lamp filaments during the operating phase.

Although the present invention has been described with reference to certain preferred embodiments, numerous modifications and variations can be made by those skilled in the art without departing from the novel spirit and scope of this invention. For instance, although the preferred embodiments described herein are specifically directed to ballasts for powering a single gas discharge lamp, it is contemplated that the teachings of the present invention may be readily applied (e.g., with appropriate modifications to output circuits 400, 400' and so forth) to ballasts for powering two or more lamps, as well as to ballasts that include two or more series resonant circuits.

What is claimed is:

1. A ballast for powering at least one gas discharge lamp having first and second lamp filaments, the ballast comprising:

an inverter operable to provide an inverter output voltage having an operating frequency;

a resonant output circuit coupled between the inverter and the lamp, the resonant output circuit being characterized by having a first resonant frequency and a second resonant frequency, wherein the first resonant frequency is substantially greater than the second resonant frequency;

a filament heating and ignition control circuit coupled to the output circuit and to the inverter, wherein the control circuit is operable to control the inverter and the resonant output circuit such that:

(a) during a preheat phase, the resonant output circuit: (i) has an effective resonant capacitance corresponding to the first resonant frequency; and (ii) provides a first level of heating to the first and second lamp filaments of the at least one gas discharge lamp;

(b) during a normal operating phase following the preheat phase, the resonant output circuit: (i) has an effective resonant capacitance corresponding to the second resonant frequency; and (ii) provides a second level of heating to the first and second lamp filaments of the at least one gas discharge lamp, wherein the second level of heating is negligible in comparison with the first level of heating;

wherein the control circuit is further operable:

(a) to monitor a voltage within the resonant output circuit;

(b) in response to the monitored voltage reaching a specified level, to provide the preheat phase wherein the operating frequency of the inverter is maintained at a first present value for a predetermined preheating period; and (c) upon completion of the preheat phase, to provide the operating phase wherein the operating frequency of the inverter is allowed to decrease from the first present value for purposes of igniting and operating the lamp.

2. A ballast for powering at least one gas discharge lamp having first and second lamp filaments, the ballast comprising:

an inverter operable to provide an inverter output voltage having an operating frequency;

a resonant output circuit coupled between the inverter and the lamp, the resonant output circuit being characterized by having a first resonant frequency and a second resonant frequency, wherein the first resonant frequency is substantially greater than the second resonant frequency;

a filament heating and ignition control circuit coupled to the output circuit and to the inverter, wherein the control circuit is operable to control the inverter and the resonant output circuit such that:

(a) during a preheat phase, the resonant output circuit: (i) has an effective resonant capacitance corresponding to the first resonant frequency; and (ii) provides a first level of heating to the first and second lamp filaments of the at least one gas discharge lamp;

(b) during a normal operating phase following the preheat phase, the resonant output circuit: (i) has an effective resonant capacitance corresponding to the second resonant frequency; and (ii) provides a second level of heating to the first and second lamp filaments of the at least one gas discharge lamp, wherein the second level of heating is negligible in comparison with the first level of heating;

wherein the resonant output circuit includes:

a first resonant capacitor;

an auxiliary resonant capacitor; and an electronic switch coupled in series with the auxiliary resonant capacitor, wherein the auxiliary resonant capacitor and the electronic switch form a series circuit that is coupled in parallel with the first resonant capacitor; and the filament heating and ignition control circuit is operable:

(a) during the preheat phase, to deactivate the electronic switch; and (b) during the normal operating phase, to activate the electronic switch, thereby effectively coupling the auxiliary resonant capacitor in parallel with the first resonant capacitor.

3. A ballast for powering at least one gas discharge lamp having first and second lamp filaments, the ballast comprising:

an inverter operable to provide an inverter output voltage having an operating frequency;

a resonant output circuit coupled between the inverter and the lamp, the resonant output circuit being characterized by having a first resonant frequency and a second resonant frequency, wherein the first resonant frequency is substantially greater than the second resonant frequency;

a filament heating and ignition control circuit coupled to the output circuit and to the inverter, wherein the control circuit is operable to control the inverter and the resonant output circuit such that:

(a) during a preheat phase, the resonant output circuit: (i) has an effective resonant capacitance corresponding to the first resonant frequency; and (ii) provides a first level of heating to the first and second lamp filaments of the at least one gas discharge lamp;

(b) during a normal operating phase following the preheat phase, the resonant output circuit: (i) has an effective resonant capacitance corresponding to the second resonant frequency; and (ii) provides a second level of heating to the first and second lamp filaments of the at least one gas discharge lamp, wherein the second level of heating is negligible in comparison with the first level of heating;

wherein the resonant output circuit includes:

a first resonant capacitor;

an auxiliary resonant capacitor; and an electronic switch coupled in parallel with the auxiliary resonant capacitor, wherein the auxiliary resonant capacitor and the electronic switch form a parallel circuit that is coupled in series with the first resonant capacitor; and the filament heating and ignition control circuit is operable:

(a) during the preheat phase, to deactivate the electronic switch, thereby allowing the auxiliary resonant capacitor to be effectively coupled in series with the first resonant capacitor; and (b) during the normal operating phase, to activate the electronic switch.

4. A ballast for powering at least one gas discharge lamp having first and second lamp filaments, the ballast comprising:

an inverter having an inverter output terminal and being operable to provide, at the inverter output terminal, an inverter output voltage having an operating frequency;

a resonant output circuit coupled between the inverter output terminal and the lamp, and operable to provide: (i) heating voltages for heating each of the first and second lamp filaments; (ii) an ignition voltage for igniting the lamp; and (iii) a magnitude-limited current for operating the lamp, wherein the resonant output circuit includes:

a first resonant capacitor;

an auxiliary resonant capacitor coupled to the first resonant capacitor; and an electronic switch coupled to the auxiliary resonant capacitor; and a filament heating and ignition control circuit coupled to the output circuit and to the inverter, wherein the control circuit is operable:

(a) to monitor a voltage within the resonant output circuit;

(b) in response to the monitored voltage reaching a specified level, to provide a preheat phase wherein: (i) the electronic switch within the resonant output circuit is turned off and (ii) the operating frequency of the inverter is maintained at a first present value for a predetermined preheating period; and (c) upon completion of the preheat phase, to provide an operating phase wherein: (i) the electronic switch within the resonant output circuit is turned on; and (ii) the operating frequency of the inverter is allowed to decrease from the first present value for purposes of igniting and operating the lamp.

5. The ballast of claim 4, wherein the resonant output circuit comprises a series-resonant type output circuit.

6. The ballast of claim 4, wherein:

the resonant output circuit further comprises:

first and second output connections adapted for coupling to the first filament of the lamp;

third and fourth output connections adapted for coupling to the second filament of the lamp;

a resonant inductor, comprising a primary winding, a first secondary winding, and a second secondary winding, wherein the primary winding is coupled to the inverter output terminal;

a first filament capacitor coupled in series with the first secondary winding of the resonant inductor, wherein the first filament capacitor and the first secondary winding are coupled in series between the first and second output connections;

a second filament capacitor coupled in series with the second secondary winding of the resonant inductor, wherein the second filament capacitor and the second secondary winding are coupled in series between the third and fourth output connections;

a direct current (DC) blocking capacitor coupled between the fourth output connection and circuit ground; and a voltage-divider capacitor coupled between the first resonant capacitor and circuit ground; and wherein:

the first resonant capacitor is coupled between the second output connection and a first node;

the voltage divider capacitor is coupled between the first node and circuit ground; and the auxiliary resonant capacitor and the electronic switch are arranged as a series circuit coupled between the second output connection and circuit ground.

7. The ballast of claim 4, wherein:

the resonant output circuit further comprises:

first and second output connections adapted for coupling to the first filament of the lamp;

third and fourth output connections adapted for coupling to the second filament of the lamp;

a resonant inductor, comprising a primary winding, a first secondary winding, and a second secondary winding, and an auxiliary secondary winding, wherein the primary winding is coupled to the inverter output terminal;

a first filament capacitor coupled in series with the first secondary winding of the resonant inductor, wherein the first filament capacitor and the first secondary winding are coupled in series between the first and second output connections;

a second filament capacitor coupled in series with the second secondary winding of the resonant inductor, wherein the second filament capacitor and the second secondary winding are coupled in series between the third and fourth output connections; and a direct current (DC) blocking capacitor coupled between the fourth output connection and circuit ground;

a coupling capacitor coupled in series with the auxiliary secondary winding, wherein a series combination of the coupling capacitor and the auxiliary secondary winding is coupled to the control circuit; and wherein:

the first resonant capacitor is coupled between the second output connection and a first node; and the auxiliary resonant capacitor and the electronic switch are arranged as a parallel circuit coupled between the first node and circuit ground.

8. The ballast of claim 4, wherein the inverter comprises:

an input for receiving a source of substantially direct current (DC) voltage;

an inverter output terminal;

at least a first inverter switch; and an inverter driver circuit coupled to at least the first inverter switch and operable to commutate the first inverter switch at the operating frequency, the inverter driver circuit comprising:

a DC supply input for receiving operating current from a DC voltage supply; and a voltage controlled oscillator (VCO) input, wherein the operating frequency is set in dependence upon a voltage provided to the VCO input.

9. The ballast of claim 8, wherein the control circuit comprises:

a voltage detection circuit coupled to the resonant output circuit;

a frequency-hold circuit coupled between the voltage detection circuit and the VCO input of the inverter driver circuit; and a timing control circuit coupled to the electronic switch of the resonant output circuit and to the frequency-hold circuit.

10. The ballast of claim 9, wherein the voltage detection circuit includes a detection output and is operable to provide a detection signal at the detection output in response to the monitored voltage within the resonant output circuit reaching the specified level.

11. The ballast of claim 10, wherein the voltage detection circuit further comprises:

a first diode having an anode and a cathode;

a second diode having an anode and a cathode, wherein:

the anode of the first diode is coupled to the cathode of the second diode, and to the resonant output circuit; and the anode of the second diode is operably coupled to circuit ground;

a low-pass filter comprising a series combination of a filter resistor and a filter capacitor, wherein the filter resistor is coupled to the cathode of the first diode and the series combination is coupled between the cathode of the first diode and circuit ground; and a zener diode having an anode and a cathode, wherein the anode is coupled to the detection output and the cathode is coupled to a junction between the filter resistor and the filter capacitor.

12. The ballast of claim 9, wherein the timing control circuit includes a first output coupled to the electronic switch of the resonant output circuit, and a second output coupled to the frequency-hold circuit.

13. The ballast of claim 12, wherein the timing control circuit comprises a programmable microcontroller, and is operable, during the preheat phase, to provide:

(i) a preheat control signal at the first output for deactivating the electronic switch of the resonant output circuit; and (ii) an enable signal at the second output for enabling the frequency-hold circuit.

14. The ballast of claim 13, wherein the frequency-hold circuit is operable, in response to the detection signal and to the enable signal, to substantially maintain the voltage provided to the VCO input at a present level for the predetermined period of time.

15. The ballast of claim 14, wherein the frequency-hold circuit further comprises:

a first electronic switch having a base, an emitter, and a collector;

a second electronic switch having a gate, a source, and a drain, wherein:

the gate is coupled to the second output of the timing control circuit;

the source is coupled to circuit ground; and the drain is coupled to the emitter of the first electronic switch;

a first biasing resistor coupled between the detection output of the voltage detection circuit and the base of the first electronic switch;

a second biasing resistor coupled between the base of the first electronic switch and circuit ground; and a pull-down resistor coupled between the VCO input of the inverter driver circuit and the collector of the first electronic switch.

16. A ballast for powering at least one gas discharge lamp having first and second lamp filaments, the ballast comprising:

an inverter, comprising:

an input for receiving a source of substantially direct current (DC) voltage;

an inverter output terminal;

at least a first inverter switch; and an inverter driver circuit coupled to at least the first inverter switch and operable to commutate the first inverter switch at the operating frequency, the inverter driver circuit comprising:

a DC supply input for receiving operating current from a DC voltage supply; and a voltage controlled oscillator (VCO) input, wherein the operating frequency is set in dependence upon a voltage provided to the VCO input;

a resonant output circuit coupled between the inverter output terminal and the lamp, and operable to provide: (i) heating voltages for heating each of the first and second lamp filaments; (ii) an ignition voltage for igniting the lamp; and (iii) a magnitude-limited current for operating the lamp, wherein the resonant output circuit includes:

a first resonant capacitor;

an auxiliary resonant capacitor coupled to the first resonant capacitor; and an electronic switch coupled to the auxiliary resonant capacitor; and a filament heating and ignition control circuit, comprising:

a voltage detection circuit coupled to the resonant output circuit;

a frequency-hold circuit coupled between the voltage detection circuit and the VCO input of the inverter driver circuit; and a timing control circuit coupled to the electronic switch of the resonant output circuit and to the frequency-hold circuit.

17. The ballast of claim 16, wherein the voltage detection circuit comprises:

a detection output coupled to the frequency-hold circuit;

a first diode having an anode and a cathode;

a second diode having an anode and a cathode, wherein:

the anode of the first diode is coupled to the cathode of the second diode, and to the resonant output circuit; and the anode of the second diode is operably coupled to circuit ground;

a low-pass filter comprising a series combination of a filter resistor and a filter capacitor, wherein the filter resistor is coupled to the cathode of the first diode and the series combination is coupled between the cathode of the first diode and circuit ground; and a zener diode having an anode and a cathode, wherein the anode is coupled to the detection output and the cathode is coupled to a junction between the filter resistor and the filter capacitor.

18. The ballast of claim 17, wherein the timing control circuit comprises a programmable microcontroller having: (i) a first output coupled to the electronic switch of the resonant output circuit; and (ii) a second output coupled to the frequency-hold circuit.

19. The ballast of claim 18, wherein the frequency-hold circuit further comprises:

a first electronic switch having a base, an emitter, and a collector;

a second electronic switch having a gate, a source, and a drain, wherein:

the gate is coupled to the second output of the timing control circuit;

the source is coupled to circuit ground; and the drain is coupled to the emitter of the first electronic switch;

a first biasing resistor coupled between the detection output of the voltage detection circuit and the base of the first electronic switch;

a second biasing resistor coupled between the base of the first electronic switch and circuit ground; and a pull-down resistor coupled between the VCO input of the inverter driver circuit and the collector of the first electronic switch.

20. The ballast of claim 19, wherein:

the resonant output circuit further comprises:

first and second output connections adapted for coupling to the first filament of the lamp;

third and fourth output connections adapted for coupling to the second filament of the lamp;

a resonant inductor, comprising a primary winding, a first secondary winding, and a second secondary winding, wherein the primary winding is coupled to the inverter output terminal;

a first filament capacitor coupled in series with the first secondary winding of the resonant inductor, wherein the first filament capacitor and the first secondary winding are coupled in series between the first and second output connections;

a second filament capacitor coupled in series with the second secondary winding of the resonant inductor, wherein the second filament capacitor and the second secondary winding are coupled in series between the third and fourth output connections;

a direct current (DC) blocking capacitor coupled between the fourth output connection and circuit ground; and a voltage-divider capacitor coupled between the first resonant capacitor and circuit ground; and wherein:

the first resonant capacitor is coupled between the second output connection and a first node;

the voltage divider capacitor is coupled between the first node and circuit ground; and the auxiliary resonant capacitor and the electronic switch are arranged as a series circuit coupled between the second output connection and circuit ground.

21. The ballast of claim 19, wherein:

the resonant output circuit further comprises:

first and second output connections adapted for coupling to the first filament of the lamp;

third and fourth output connections adapted for coupling to the second filament of the lamp;

a resonant inductor, comprising a primary winding, a first secondary winding, and a second secondary winding, and an auxiliary secondary winding, wherein the primary winding is coupled to the inverter output terminal;

a first filament capacitor coupled in series with the first secondary winding of the resonant inductor, wherein the first filament capacitor and the first secondary winding are coupled in series between the first and second output connections;

a second filament capacitor coupled in series with the second secondary winding of the resonant inductor, wherein the second filament capacitor and the second secondary winding are coupled in series between the third and fourth output connections; and a direct current (DC) blocking capacitor coupled between the fourth output connection and circuit ground;

a coupling capacitor coupled to the auxiliary secondary winding, wherein a series combination of the coupling capacitor and the auxiliary secondary winding is coupled to the control circuit; and wherein:

the first resonant capacitor is coupled between the second output connection and a first node; and the auxiliary resonant capacitor and the electronic switch are arranged as a parallel circuit coupled between the first node and circuit ground.

* * * * *